US005785576A

United States Patent [19]

Belton

[11] Patent Number: 5,785,576

[45] Date of Patent: Jul. 28, 1998

[54] RADIO CONTROLLED VEHICLE WITH SELECTABLE VEHICLE SUSPENSION SYSTEM

[75] Inventor: Wyatt H. Belton, Richmond, Va.

[73] Assignee: Sports Wheels, Inc., Richmond, Va.

[21] Appl. No.: 771,510

[22] Filed: Dec. 23, 1996

[51] Int. Cl.[6] ..... A63H 30/04; A63H 17/26

[52] U.S. Cl. ..... 446/456; 446/437; 446/466; 280/688; 280/43.23

[58] Field of Search ..... 446/456, 466, 446/462, 469, 437, 454; 280/688, 43.23

[56] References Cited

U.S. PATENT DOCUMENTS

| | | |
|---|---|---|
| 4,666,420 | 5/1987 | Nagano . |
| 4,696,655 | 9/1987 | D'Andrade et al. . |
| 5,334,077 | 8/1994 | Bailey . |
| 5,527,059 | 6/1996 | Lee, Jr. . |

*Primary Examiner*—Mickey Yu
*Attorney, Agent, or Firm*—J. Michael Martinez de Andino; McGuire, Woods, Battle & Boothe LLP

[57] ABSTRACT

A toy wheeled vehicle having a chassis and a selectable vehicle suspension system, with the vehicle having a frame and a chassis attached to the frame. The vehicle has at least one opening through the chassis, longitudinally spaced rotatable front and rear axles supported on the frame, and a first and second set of wheels attached to the front and rear axles, respectively. The vehicle also has at least one lifting motor mounted on the frame and has a first rotatable arm connected to a vertically extending guide post, with the guide post being vertically extendable through the chassis opening and being connected to the chassis. At least one driving motor is mounted on the frame and has a rotatable shaft connected to the rear axle. Further, at least one hopping actuating motor is mounted on the frame and has a second rotatable arm connected to the front axle. At least one power supply is mounted on the frame and has electrical connections with the lifting motor, the driving motor and the hopping actuating motor. A switch for selectively energizing the lifting motor, the driving motor and the hopping actuating motor through a control circuit that is electrically connected to the power supply and the lifting motor, the driving motor and the hopping actuating motor. A radio controller transmits control signals to the control circuit for controlling the individual or in unison movement of the lifting motor, the driving motor and the hopping actuating motor.

9 Claims, 6 Drawing Sheets

RADIO CONTROLLED VEHICLE WITH SELECTABLE VEHICLE SUSPENSION SYSTEM

TECHNICAL FIELD

The present invention relates to radio controlled toy vehicles. More precisely, it relates to a radio controlled vehicle with a selectable vehicle suspension system.

BACKGROUND OF THE INVENTION

There are toy vehicles and models that are radio controlled or that are remotely operated. There are also toy vehicles and models that have adjustable vehicle suspension systems, such as the vehicle described in U.S. Pat. No. 4,696,655, which has four wheels that are connected to the vehicle's body through a suspension system such that the body may be raised or lowered by pulling or pushing on the wheels away from or toward the underside of the body. The '655 Patent suspension system discloses the use of flexible, hollow plastic tubes that are stretched to sequential lengths until the tubes assume a longitudinally spaced position. There are also remotely controlled toy vehicles and models, such as the vehicle described in U.S. Pat. No. 5,334,077, which has a lift assembly that moves the vehicle's chassis relative to each of the vehicles's axles. The '077 Patent lift assembly includes front and rear motors that are connected to front and rear output shafts, respectively, and front and rear transmissions for converting the rotational movement of the respective output shafts into a lifting movement for lifting the chassis relative to the vehicle's axles. The '077 Patent vehicle also includes laterally opposed side walls connected to the chassis with vertical slots in the side walls for allowing the front and rear axles to extend through the vertical slots and which act as a guide means for maintaining the transverse orientation of the axles while allowing movement of the axles relative to the chassis.

Further, there are remotely controlled adjustable vehicle suspension systems for toys or models, such as described in U.S. Pat. No. 5,527,059, which have a motor connected to each of the vehicle's wheels and a suspension arm fixed to the output shaft of a reduction gear set for each motor. The suspension arm can be pivotally driven or angularly displaced which allows for each of the wheels to be raised or lowered relative to the vehicle body. The above-mentioned remotely controlled vehicles and adjustable suspension systems, however, are not radio controlled and do not have, use or disclose a radio controlled vehicle or model that has a body post located by each wheel, with each body post connected to an actuating arm that is connected to a servo motor for raising and lowering the body post and which is not connected to a reduction gear set. The above-mentioned remotely controlled vehicles and adjustable suspension systems do not disclose or describe the use of body posts whose movement causes the corner of vehicle's body to be raised or lowered independently or in unison with the movement of the other body posts, and which are independent of the drive motor.

The above-mentioned remote controlled vehicles and adjustable suspension systems also do not describe a radio controlled vehicle that has body posts which cause the vehicle's body to tilt left or right while the vehicle is moving forward or reverse, and can also raise or lower the vehicle's front or rear sections. Further, the above-mentioned remote controlled vehicles and adjustable suspension systems do not disclose or describe the use of a hopping action servo motor in a radio controlled vehicle which can have the front end of the vehicle bounce off the ground surface. Accordingly, there is a need for a radio controlled toy or model vehicle with a selectable vehicle suspension system that would provide for each corner of the vehicle's chassis to tilt in unison with or independently from the remaining corners of the chassis, while the vehicle is in motion or is stationary.

Further, there is a need for a radio controlled toy vehicle or model that has a selectable vehicle suspension system which has a drive motor separate from wheel servo motors that are connected to body posts and which allow for the tilting, lowering and raising of the vehicle's chassis, in unison or independently via radio control, while the vehicle is stationary or in motion.

In order to overcome the above-mentioned defects in the previously known remote controlled toy or model vehicles and adjustable suspension systems for toy or model vehicles, there is a need for a radio controlled toy or model vehicle with a selectable suspension system that tilts the corners of the vehicle and raises or lowers the front and rear sections of the chassis, in unison or independently via remote control. There is also a need for a radio controlled toy or model vehicle with a selectable suspension system that does not require the use of a transmission means for converting the rotation motion of an output shaft of a drive motor for raising, tilting or lowering the chassis of an vehicle. There is also a need for a radio controlled toy or model vehicle with a selectable suspension system that has wheel servo motors for tilting, raising and lowering the corners and the front and rear sections of the chassis of the vehicle and a hopping action servo motor for bouncing the front section of the vehicle via radio control. The radio controlled toy or model vehicle with a selectable suspension system of the present invention meeting these requirements is described in more detail below.

SUMMARY OF THE INVENTION

In accordance with the present invention, the disadvantages of the prior methods and systems for remotely controlling a toy or model vehicle with a selectable suspension system has been overcome. The radio controlled vehicle with a selectable suspension system of the present invention eliminates the requirement of having a transmission means for converting the rotational movement of an output shaft of a drive motor for lifting, tilting or lowering the vehicle's chassis. Additionally, the present invention includes a hopping servo motor that causes the front section of the vehicle to bounce while the vehicle is stationary or in motion.

According to the present invention, the radio controlled vehicle with a selectable suspension system consists of a radio controlled toy or model vehicle that has four servo motors connected to body post guides which are attached to the four corners of the vehicle's chassis. The servo motors are electrically powered by a battery power source which can be separate from the battery power source for the drive motor that is connected to the front and rear axles of the vehicle for moving the vehicle forwards or reverse. The vehicle also has a hopping servo motor that is connected to a front servo mount and post guide which are connected to the front section of the chassis. The hopping servo motor is radio controlled and provides a means for the front section of the vehicle's frame to bounce the front section of the chassis relative to the front axle.

The vehicle's chassis can be tilted, lowered or raised while the vehicle is in motion or is stationary through the radio controlled actuation of the four servo motors which cause the body post guides to move vertically relative to the front or rear axles, and can be radio controlled to be actuated in unison or independently of each other.

Accordingly, it is the primary object of the present invention to provide a radio controlled vehicle with a selectable suspension system that provides for the tilting, raising or lowering of the vehicle's chassis relative to the front and rear axles.

It is a further object of the present invention to provide a radio controlled vehicle with a selectable suspension system that has a hopping servo motor connected to the front section of the chassis for bouncing the front section of the vehicle's frame.

It is another object of the present invention to provide a radio controlled vehicle with a selectable suspension system that provides for the tilting, raising or lowering of the vehicle's chassis relative to the front and rear axles while the vehicle is in motion or is stationary.

It is a further object of the present invention to provide a radio controlled vehicle with a selectable suspension system that provides for the tilting, raising or lowering of the vehicle's chassis relative to the front and rear axles while the vehicle is in motion or is stationary, and which has a radio controlled hopping servo motor that is connected to the front section of the frame for bouncing the front section of the frame, and a separate drive motor for moving the vehicle. Other objects and advantages of this invention will become apparent from the following description wherein is set forth, by way of illustration and example, certain embodiments of this invention.

DETAILED DESCRIPTION OF THE PREFERRED EMBODIMENTS

Figure 1:
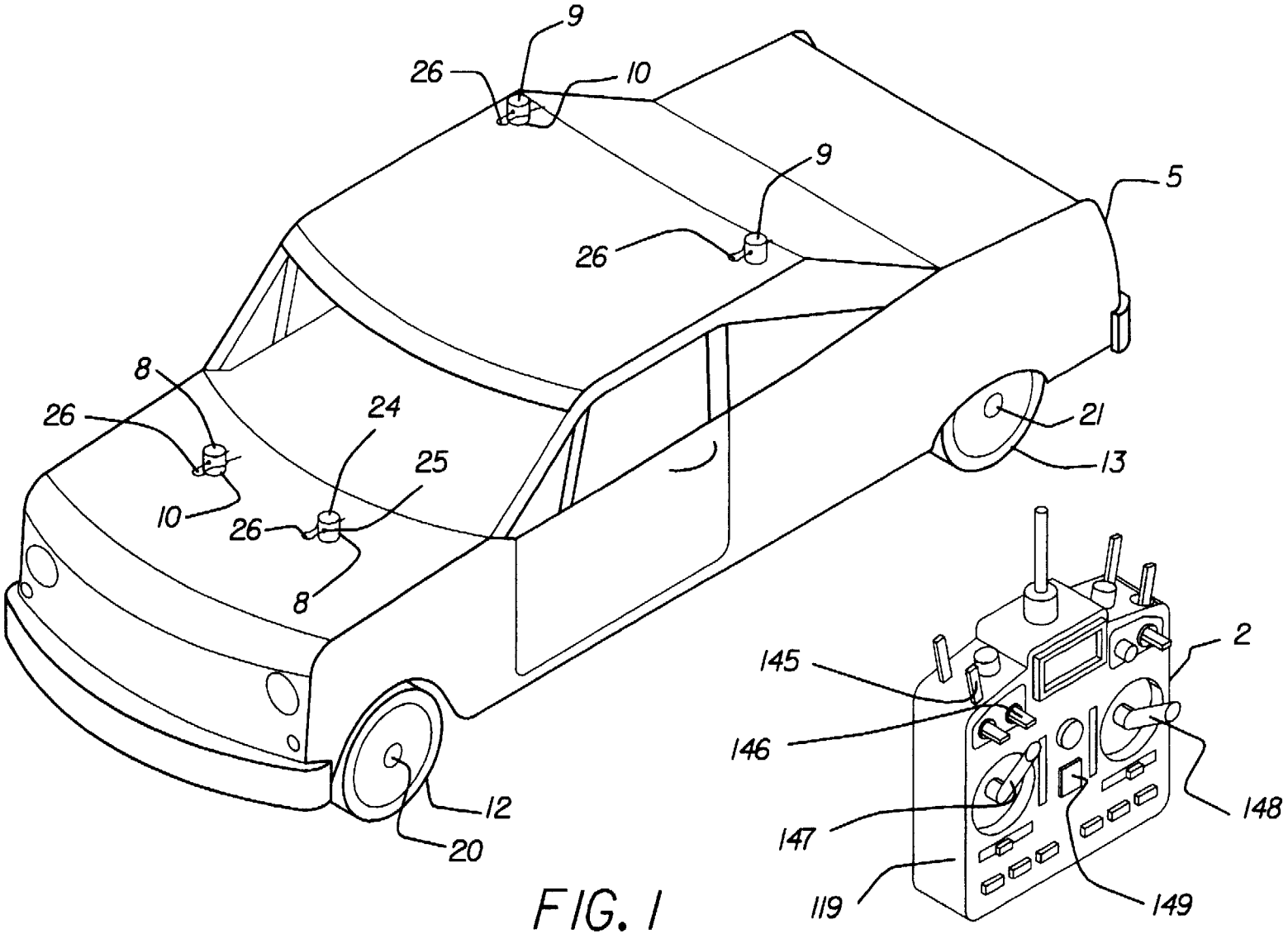
FIG. 1 is a perspective view of a radio controlled vehicle with a selectable suspension system.

Referring now to the drawings, a typical embodiment of the invention is shown in FIGS. 1–5. Before the present invention is described, however, it is to be understood that this invention is not limited to a particular or specific description. It is also to be understood that the terminology used herein is for the purpose of describing particular embodiments only, and is not intended to be limiting, as the scope of the present invention will be limited only by the appended claims. Further, unless defined otherwise, all terms used herein have the same meaning as commonly understood by one of ordinary skill in the art to which this invention belongs.

Figure 2:
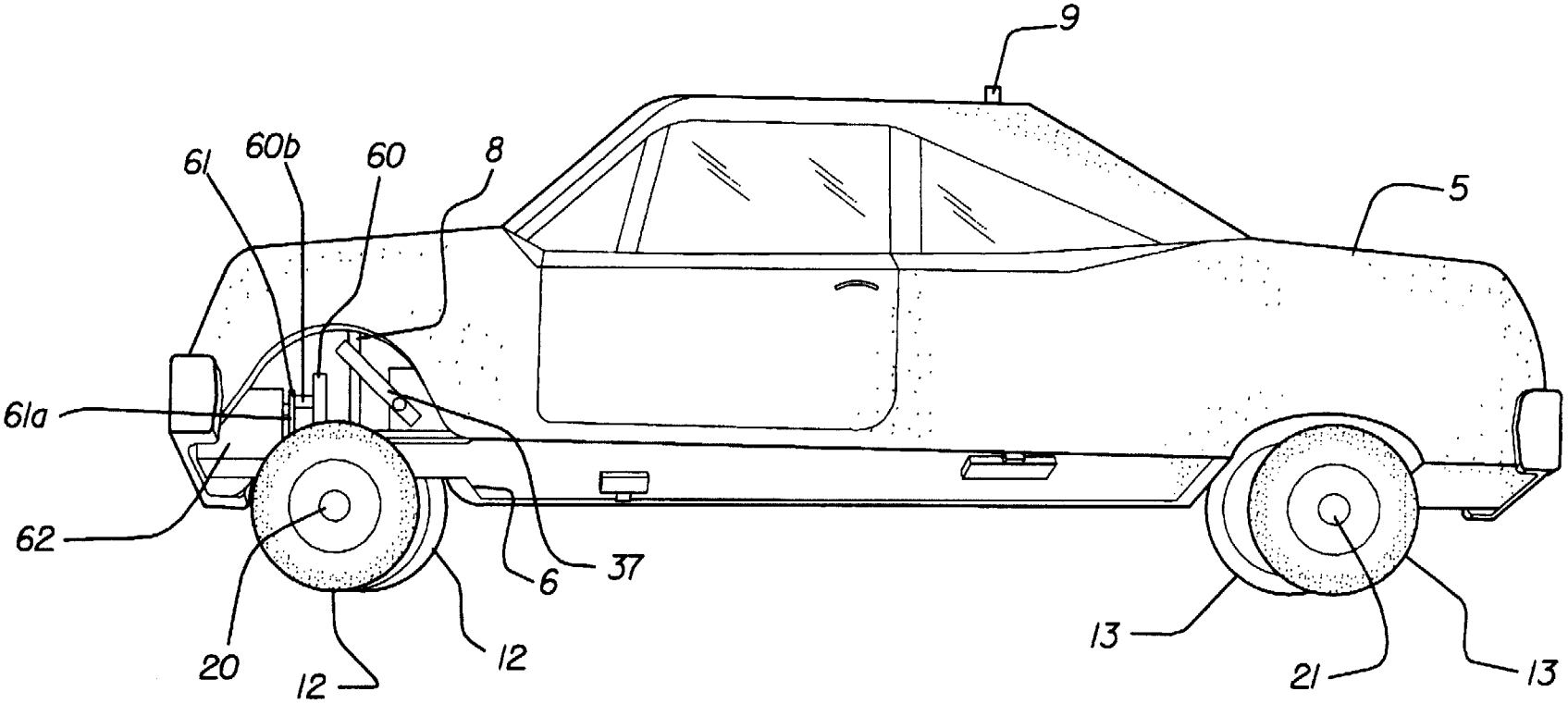
FIG. 2 is an elevational right side view of the radio controlled vehicle depicted in FIG. 1 with the front right side of the chassis elevated with respect to the front axle.
Figure 3:
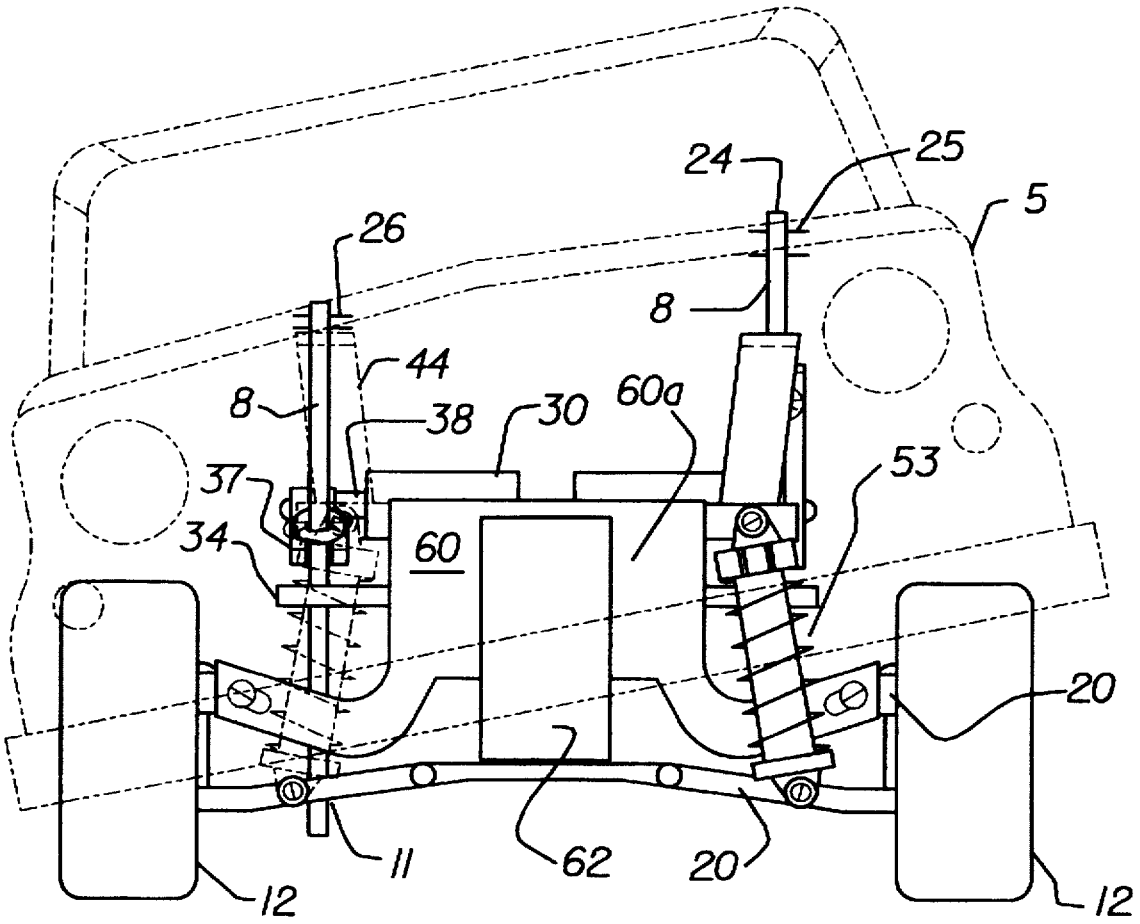
FIG. 3 is a sectional, elevational front view of the radio controlled vehicle depicted in FIG. 2.

Referring to FIGS. 1, 2 and 3, a radio controlled vehicle 1 is shown with a radio control transmitter and receiver ("radio controller") 2. Examples of radio controllers that can be used as a radio controller 2 include the aircraft model radio controller X-388S unit manufactured by JR radios, which are distributed by Horizon Hobby Distributors, Inc. The X-388S aircraft model radio controller unit is preferred because it provides an eight channel transmitter which is needed when control signals are to be transmitted to a model having separate motors that can be controlled independently or in unison of each other. An example of a radio controlled vehicle that can be modified to include the features of the present invention of the vehicle 1 is a 1/10th scale high performance racing car, such as the NISSAN 300ZX IMSA-GTS model manufactured by the TAMIYA Plastic Model Company. The chassis body of the radio controlled vehicle can be replaced or modified by obtaining different chassis designs, such as provided by BoLINK® R/C Cars, Inc.

In the present invention, the vehicle 1 has a chassis 5 which is connected to a frame 6 through the use of a pair of front and rear body posts 8 and 9, respectively, that extend vertically upward through the surface of the chassis 5 through apertures 10 and downward through the frame 6 through the apertures 11. The frame 6 defines a central longitudinal axis and has a pair of rotatable front and rear wheels 12 and 13, respectively, which are connected to front and rear axles 20 and 21, respectively. The front and rear axles 20 and 21 extend in a direction transverse to the central longitudinal axis of the frame 6. The vehicle 1 moves longitudinally forward and backward depending upon the rolling movement of the wheels 12 and 13 whose rotational movement is described in further detail below.

The Body Posts and Servo Motor System

Figure 4:
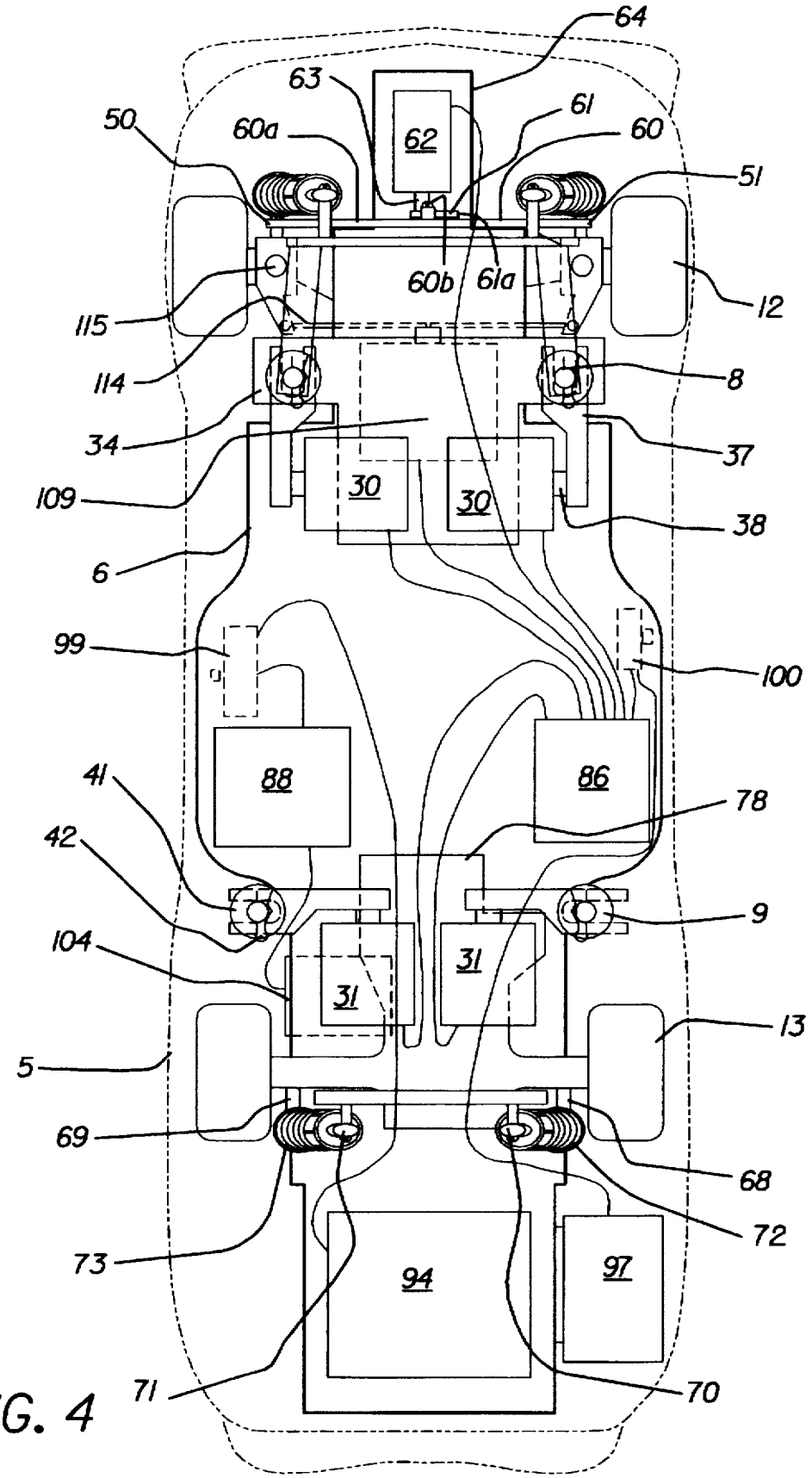
FIG. 4 is a top plan view of the radio controlled vehicle depicted in FIG. 1 showing the components of the vehicle as seen through the chassis of the vehicle.
Figure 5:
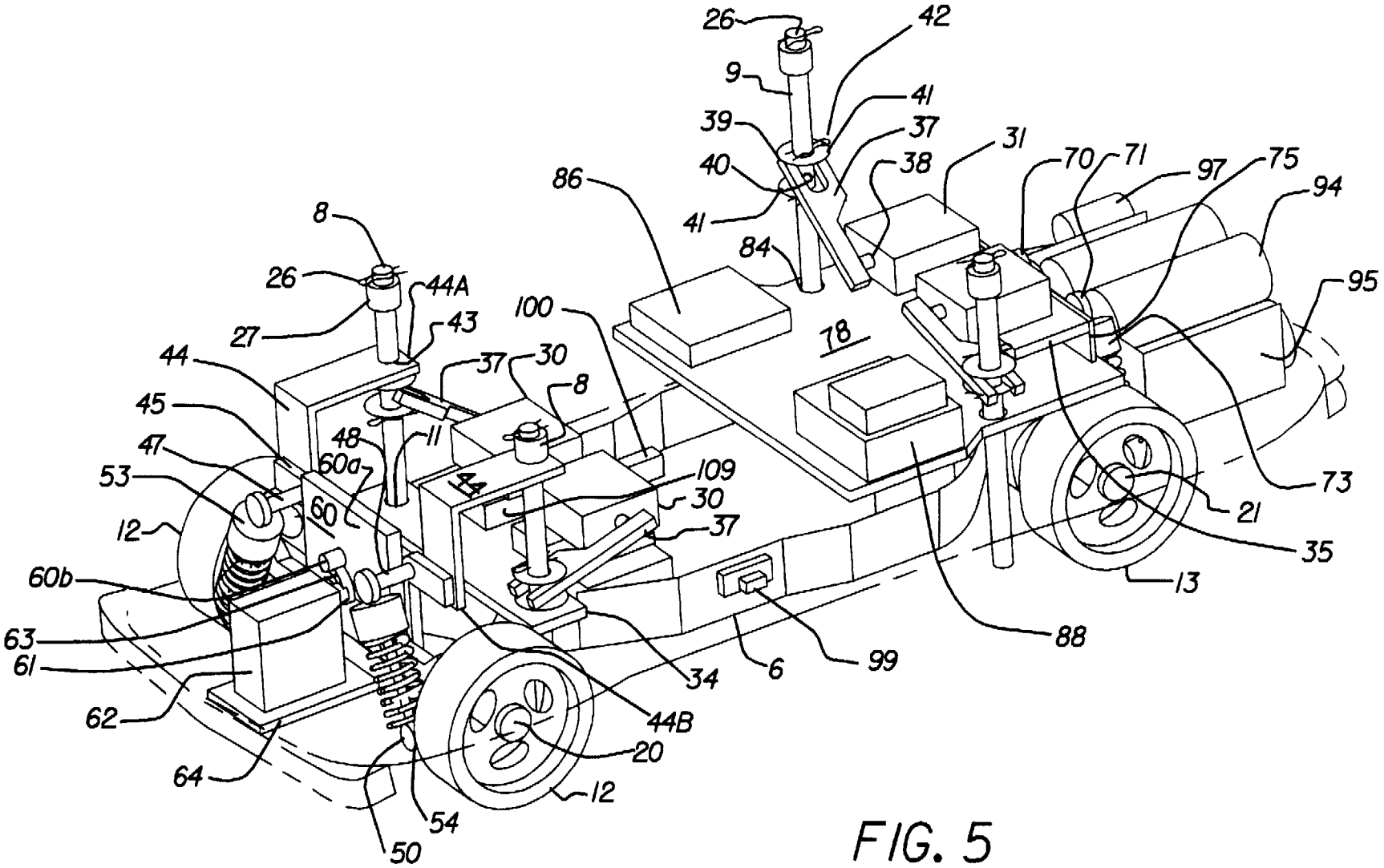
FIG. 5 is a perspective view of the radio controlled vehicle depicted in FIG. 1 showing the components of the vehicle as seen through the chassis of the vehicle.

Referring to FIGS. 1, 4 and 5, each of the body posts 8 and 9 has a top end 24 that has a channel 25 extending through the top end 24 for receiving a retainer clip 26. Each body post 8 and 9 also has a body support 27 at the top end 24 that is spaced from the channel 25 for supporting the underside of the chassis 5. The body support 27 has a surface area greater than that of the aperture 10. The chassis 5 is shown connected to the body posts 8 and 9 by having the body posts 8 and 9 extend through the apertures 10 with the chassis 5 resting on the body support 27 and being kept in place by the retainer clips 26.

The pair of body posts 8 and 9 are connected to a pair of spaced apart front and rear servo motors 30 and 31, respectively, which are attached to spaced apart front and rear servo mounts, 34 and 35, respectively. The front and rear servo mounts 34 and 35 are attached to the frame 6. The front servo mounts 34 are located in front of the front axle 20, while the rear servo mounts 35 are located behind the rear axle 20. Each of the servo motors 30 and 31 has a servo arm 37 that is attached to a reversibly rotatable output shaft 38. As shown in FIGS. 3–5, the rotation of the output shaft 38 causes the servo arm 37 to rotatably move in a clockwise or counter-clockwise direction depending on the rotational direction of the output shaft 38. The servo arm 37 also is shown to have a post connecting end 39. The post connecting end 39 has a slot 40 for receiving a body post therein. Each of the body posts 8 and 9 has a pair of washers 41 that are placed on top of and below the servo arm's slot 37. The washers 41 are held in place through the use of retainer clips 42, which are inserted through holes in the respective body post above and below the washers 41. The servo arm 37 is designed to have such a length that the outer edges of the slot 40 extend beyond the body post when the body post is raised or lowered to its highest or lowest level. The servo arm 37 is adapted to raise its connected body post by being rotatably rotated in a counter-clockwise direction by the servo motor.

Likewise, the servo arm 37 will lower its connected body post by being rotated in a clockwise direction by the servo motor.

Referring to FIGS. 3–5, the front pair of body posts 8 are adapted to vertically travel through the apertures 43 of the spaced apart L-shaped upper guides 44. The upper guides 44 are mounted in front of the body posts 8 and are attached to the frame 6 near the left and right side of the frame 6. The upper guides 44 have spaced apart first and second ends 44*a* and 44*b*, respectively. Each first end 44*a* has an aperture 43 located at the top surface of the first end 44*a*. The apertures 43 are aligned with the vertical axis of the body posts 8 such that the body posts 8 extend through the apertures 43. The second end 44*b* of the upper guides 44 are connected to the frame 6. The upper guides 44 are adapted to provide vertical directional guidance to the body posts 8 as the body posts 8 are raised and lowered by the movement of the servo arms 37.

The Front Wheel Suspension System

Referring to FIGS. 3 and 5, attached to each of the second ends 44*b* of the upper guides 44 is a front shock mounting bracket 45. The front shock mounting brackets 45 are approximately positioned in front of the front body posts 8 and above the front axle 20. The front shock mounting brackets 45 are rectangular braces that are adapted to support spaced apart upper shock mounts 47 and 48. The spaced apart upper shock mounts 47 and 48 are connected to spaced apart lower shock mounts 50 and 51, respectively, by front shock spring assemblies 53 and 54, respectively. The lower shock mounts 50 and 51 are connected to the front axle 20 near the front wheels 12. The front shock spring assemblies 53 and 54 are adapted to provide front wheel suspension to the front axle 20 and the front wheels 12. The front shock spring assemblies 53 and 54 are of conventional design that include the use of a spring with a center extendable and contractible rod.

The Front Hopper Actuator

Referring to FIGS. 3–5, attached to the lower shock mounts 50 and 51 and located in the space created by the spaced apart upper shock mounts 47 and 48 is a hopper actuator arm 60. The hopper actuator arm 60 has a rectangular center section with opposite extending arms, with each opposite extending arm being connected to the front axle 20 near a front wheel 12. The hopper actuator arm 60 is connected to an offset rotating cam 61, which is connected to a hopper servo motor 62 by an actuator post 63. The hopper servo motor 62 is attached to a hopper servo mount 64 that is connected to the frame 6 and which is located in front of the front axle 20 and the front tires 12, but behind the leading edge of the frame 6.

As shown in FIGS. 4 and 5, the offset rotating cam 61 has a circumference that has a radius greater on one portion of the cam, such that as the cam 61 rotates the outer edge of the cam 61 is adapted to raise the hopper actuator arm 60 when the circumference portion of the cam 61 with the greater radius makes contact with the hopper actuator arm 60. The offset rotation by the offset rotating cam 61 occurs when the hopper actuator post 63 is rotated by the hopper servo motor 62. The offset rotating cam 61, when rotated, is adapted to cause the hopper actuator arm 60 to move down slowly and bounce rapidly up because of the combined movement of the offset portion of the cam 61 and the front shock spring assemblies 53 and 54. As shown in FIG. 3, the offset rotation causes the hopper actuating arm 60 to bounce relative to the ground surface. The bouncing motion causes the front section of the frame 6 to bounce, because the front axle 20 is forced to bounce when the extended arms of the hopper actuator arm 60 move up and down, which in turn causes the front axle 20 to move up and down.

Further, as shown in FIGS. 2–5, on the front surface 60*a* of the hopper actuator arm 60 that faces the hopper servo motor 62, a pin 60*b* is shown extending toward the hopper servo motor 62. As shown in FIGS. 2, 4 and 5, the pin 60*b* is connected to the front surface 60*a*. The pin 60*b* is momentarily supported by and rests on the outer edge 61*a* of the cam 61. The cam 61 has an offset semi-circular shape and has a first cam end, which is connected to the actuator post 63 and which has the shortest radius of the cam 61, and a second cam end that is located at the greatest radius of the cam 61. When the cam 61 is rotated by the actuator post 63, the pin 60*b* travels along the outer edge 61*a* of the cam 61 from the first cam end toward the second cam end. The rotation of the cam 61 causes the pin 60*b* to travel along the offset semi-circular shaped outer edge 61*a* of the cam 61, thereby causing the hopper actuator arm 60 to rise. As the cam 61 is further rotated and the pin 60*b* travels beyond the second cam end, the pin 60*b* and the hopper actuator arm 60 are allowed to fall relative to the ground surface. The front shock spring assemblies 53 and 54 cause the pin 60*b* and the hopper actuator arm 60 to bounce back up toward the cam 61. As the cam 61 continues to rotate, the pin 60*b* comes in contact with the outer edge 61*a* of the cam 61 near the first cam end. The continued rotation of the cam 61 with its offset semi-circular shaped outer edge 61*a* causes the pin 60*b* to rise and fall, thereby causing the hopper actuator arm 60 to rise and fall.

The Rear Wheel Suspension System

Referring now to FIGS. 4 and 5, the rear axle 21 is shown connected to spaced apart rear lower shock mounts 68 and 69 that are connected to spaced apart rear upper shock mounts 70 and 71, respectively, by rear shock spring assemblies 72 and 73, respectively. The rear upper shock mounts 70 and 71 and the rear shock spring assemblies 72 and 73 are similar in design to the front upper shock mounts 47 and 48 and the front shock spring assemblies 53 and 54, respectively.

The rear upper shock mounts 70 and 71 are located above and behind the rear axle 21 and are connected to the rear shock mounting bracket 75, which is connected to the frame 6 and to the rear servo mounts 35. Also connected to the rear shock mounting bracket 75, but located below the rear servo mount 35, is the control support mount 78, which is a platform that extends forward of the rear axle 21 to approximately midway along the length of the frame 6. The control support mount 78 has apertures 84 that are aligned with the vertical axis of the body posts 9, such that the body posts 9 can extend and retract through the apertures 84 of the control support mount 78 when the rear servo motors 31 are energized.

The Control Systems

Figure 6:
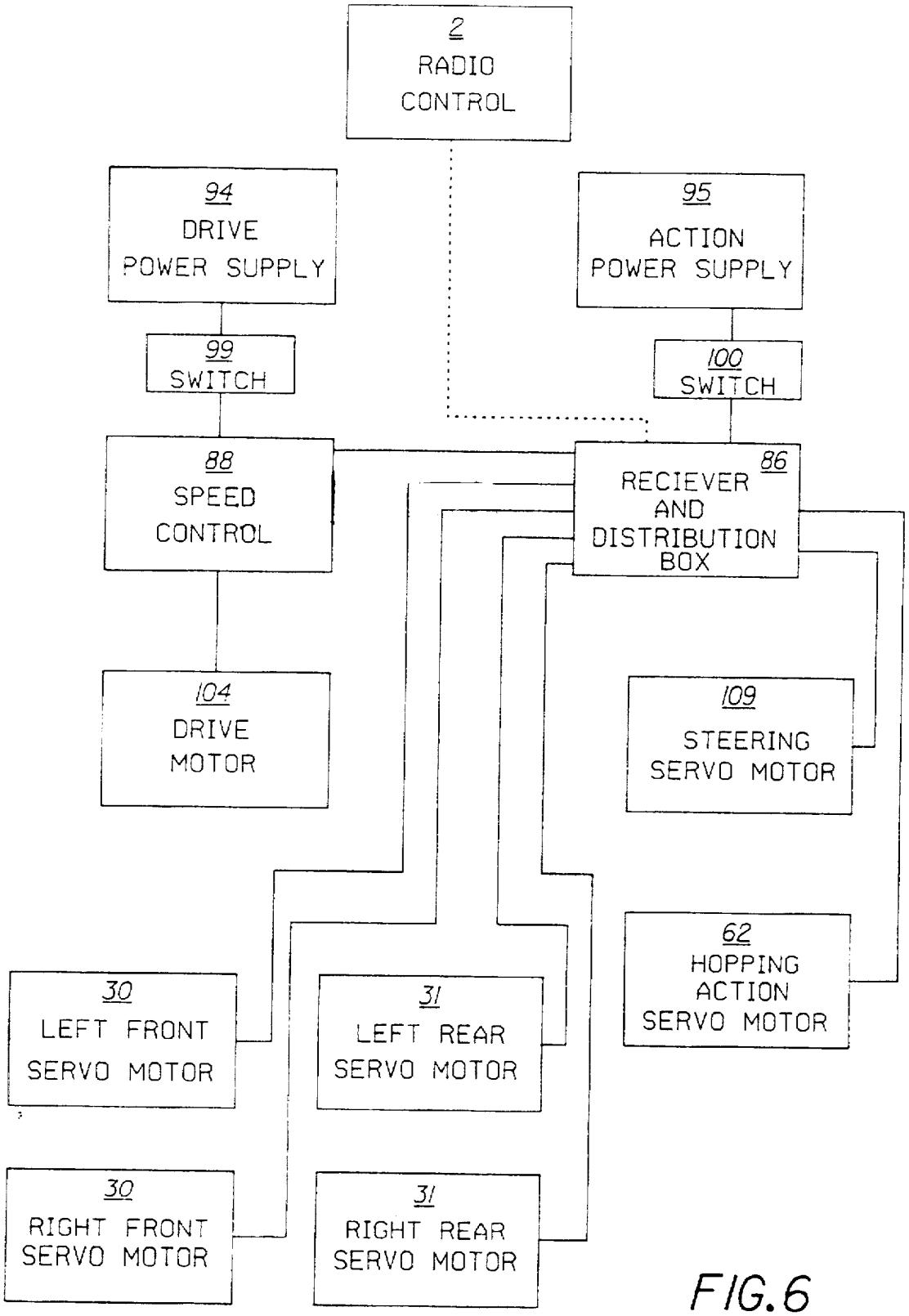
FIG. 6 is an electrical block diagram of the radio controlled vehicle depicted in FIG. 1.

Mounted on and attached to the control support mount 78 is a receiver and distributor box 86 and a drive speed control 88. As shown in FIGS. 4–6, the receiver and distributor box 86 receives electrical control signals from the radio controller 2. The vehicle 1 has a vehicle drive battery power supply 94 which is mounted on and attached to a power supply support 95. The power supply support 95 is a support platform that is connected to the frame 6 and is located behind the rear axle 21 and in front of the trailing edge of the frame 6. Also mounted on and connected to the power supply support 95 is a servo battery power supply 97. The battery power from the drive battery power supply 94 and the servo battery power supply 97 is provided to the vehicle 1 when the drive power switch 99 and the servo power switch 100, respectively, are turned on. The drive power switch 99 is located on the left side of the frame 6 approximately midway along the length of the frame 6. The servo power switch 100 is located on the right side of the frame 6 approximately midway along the length of the frame 6. The drive and servo power switches 99 and 100, respectively, are electrically connected to the drive and servo battery power supplies 94 and 97, respectively.

As shown in FIGS. 4–6, the drive battery power supply 94 is electrically connected to a drive motor 104 through the drive power switch 99 and the speed control 88. The drive motor 104 is mounted on and connected to the frame 6 below the control servo mount 78 and in front of and adjacent to the rear axle 21. The servo battery power supply 97 is electrically connected to the receiver and distributor box 86 through the servo power switch 100. The drive motor 104 has a rotatable shaft that is connected to the rear axle 21 through a reduction gear means, such as a conventional gear box, that is adapted to rotate the rear axle 21, which in turn causes the vehicle 1 to move forward or reverse.

A steering servo motor 109 is electrically connected to the receiver and distributor box 86. The steering servo motor 109 is mounted on and connected to the frame 6, and is located behind the front axle 20 and below the front servo mount 34. The steering servo motor 109 uses conventional steering connections, such as a tie rod 114 and pivot pins 115.

Control signals are transmitted from the radio controller 2, which has a battery power supply 119. The receiver and distributor box 86 receives the control signals and sends the appropriate control signal to the appropriate motor.

For example, if the user of the vehicle 1 wishes to have the vehicle move forward, the user switches the drive power switch 99 on and has the radio controller 2 send a control signal to the drive motor 104. The control signal is first received by the speed control 88 which sends the signal to the drive motor 104 to move forward at the desired rate of speed. If the user wants to raise or lower the right front side of the chassis 5 body, the user switches the servo power switch on and has the radio controller 2 send a control signal to the receiver and distributor box 86 which in turn sends the appropriate control signal to the right front servo motor of the front pair of servo motors 30 to raise or lower the right front body post of the front body posts 8 relative to the frame 6.

Additionally, if the user wants to have the front section of the vehicle 1 bounce, the user then has the radio controller 2 send the appropriate control signal to the receiver and distributor box 86, which sends the appropriate control signal to the hopper servo motor 62. The hopper servo motor 62 causes the rotating offset cam 61 to rotate, which causes the actuator post to be alternately move up and down, thereby causing the hopper actuator arm 60 to bounce the front end of the vehicle 1.

The Operation of the Vehicle

In operation, the vehicle 1 has a radio controller 2 for transmitting control signals to the vehicle's receiver and distributor box 86. If the drive power and servo power switches 99 and 100 are turned on, the receiver and distributor box 86, which receives electrical power from the drive battery power supply 94 and the servo battery power supply 97, sends a control signal to the speed control 88 if the user wants the vehicle 1 to move forward, reverse, speed up or slow down. If the user wants the vehicle 1 to turn, the radio controller 2 sends the appropriate signal to the receiver and distributor box 86 which sends the control signal to the steering servo motor. If the user wants the vehicle 1 to have its left front side raised or lowered, the appropriate control signal is sent to the left front servo motor 30, which in turn actuates the body post 8 to raise or lower the left front side of the chassis 5.

The user can also have the vehicle 1 simultaneously or in unison raise or lower the left and right front and rear sections of the chassis 5, and/or have the front section bounce by also sending the appropriate control signal to the hopper servo motor 62, which actuates the hopper actuator arm 60. The user can further have the vehicle travel forward and reverse while having the servo motors 30 and 31 raise and/or lower the front and rear sections of the chassis 5, and also having the front section of the vehicle 1 bounce because of the actuation of the hopper servo motor 62.

SUMMARY

The vehicle 1 is disclosed to have a radio controller 2 that sends control signals to the vehicle 1 and which are received by the receiver and distributor box 86. The vehicle 1 has two battery power sources, the drive battery power source 94 and the servo battery power source 97, which are controlled by their respective on/off switch 99 and 100, respectively. The vehicle 1 has two front servo motors 30 and two rear servo motors 31 that actuate respective front and rear body posts 8 and 9 for lowering or raising the chassis 5 of the vehicle. The vehicle 1 also has a hopper servo motor that is connected to a hopper actuator arm for bouncing the front section of the vehicle. The front and rear servo motors and the hopper servo motor are electrically connected to the servo battery power supply 97 through the receiver and distributor box 86. The vehicle 1 further has a steering servo motor 109 that is electrically connected to the servo battery power supply 97 through the receiver and distributor box 86. The vehicle 1 has a drive motor 104 that is controlled by the speed control 88 through the receiver and distributor box 86, and which is powered by the drive battery power supply 94.

The vehicle 1 is adapted to be radio control operated such that control signals are transmitted by the radio controller 2 and received by the receiver and distributor box 86. The vehicle 1 can be radio controlled to travel forward or reverse, while also having the front and/or rear servo motors 30 and 31 selectively in unison or independent of one another actuate the body posts 8 and/or 9 to raise or lower the respective sections of the chassis 5. Simultaneously or independently of the above-mentioned, the vehicle 1 can have its front section bounce by the actuation of the hopper servo motor 62. It is to be understood that while certain forms of this invention have been illustrated and described, the invention is not limited thereto, except insofar as such limitations are included in the following claims.

What is claimed and described to be secured by letters patent is as follows:

1. A toy wheeled vehicle having a chassis and a selectable vehicle suspension system, comprising:

(a) a vehicle frame having a longitudinal axis, said chassis attached to said frame;

(b) longitudinally spaced front and rear axles supported on said frame, said front and rear axles extending in a transverse direction to said longitudinal axis;

(c) a first and second set of wheels attached to said front and rear axles, respectively;

(d) at least one lifting motor mounted on said frame and providing a first rotational output to a first arm, said first arm angularly displaced by said lifting motor in response to said first rotational output and having proximal and distal ends, said first arm connected to said first rotational output at said proximal end and connected to a vertically extending guide post at said distal end, whereby pivoting of said first arm moves said guide post vertically with respect to said frame, said guide post having attachment means to said chassis, whereby said vertical movement of said guide post moves said chassis vertically with respect to said frame;

(e) at least one driving motor mounted on said frame and providing a second rotational output to a shaft connected to said rear axle, said shaft rotated by said driving motor in response to said second rotational output and having first and second ends, said shaft connected to said second rotational output at said first end and connected to said rear axle at said second end, whereby rotating of said shaft rotates said rear axle;

(f) at least one hopping actuating motor mounted on said frame and providing a third rotational output to an offset cam, said offset cam rotated by said hopping actuating motor in response to said third rotational output and having third and fourth ends, said offset cam connected to said third rotational output at said third end and in contact with a rotatable pin connected to said front axle at said fourth end, whereby rotating said offset cam angularly displaces said rotatable pin and vertically moves said frame with respect to said front axle;

(g) at least one power supply mounted on said frame, said power supply having electrical connections with said lifting motor, said driving motor and said hopping actuating motor, and at least one switch for selectively energizing said lifting motor, said driving motor and said hopping actuating motor;

(h) a control circuit mounted on said frame and having electrical connection means with said power supply through said switch and said lifting motor, said driving motor and said hopping actuating motor; and (i) a radio controller having means for transmitting control signals to said control circuit, said control circuit having means for selectively controlling the movement of said first, second and third rotational outputs, respectively, of said lifting motor, said hopping actuating motor and said driving motor, respectively, in response to said control signals, whereby vehicle, chassis and frame movement is individually or in unison controlled.

2. A toy wheeled vehicle as set forth in claim 1 wherein said vehicle has a steering motor mounted on said frame and connected to said front axle, said steering motor has electrical connections with said control circuit and means for steering said vehicle in response to said control signals from said radio controller.

3. A toy wheeled vehicle as set forth in claim 1, wherein said chassis has four corners and said vehicle has four of said lifting motors for tilting, raising, and lowering said corners in unison or independently from one another in response to said control signals from said radio controller.

4. A toy wheeled vehicle as set forth in claim 10, wherein said chassis has at least one opening that is aligned with said guide post, said guide post has bottom and top ends and is connected to said first arm at said bottom end, said top end has an extending ledge that has a surface area greater than that of said opening and a channel spaced from said ledge and receives fastener, whereby said top end is extended through said opening until said ledge is placed adjacent to the bottom surface of said chassis, said channel is located above said opening and said fastener is inserted in said channel for attaching said guide post to said chassis.

5. A toy wheeled vehicle as set forth in claim 2, wherein said control circuit has means for selectively controlling the individual or in unison movement of said lifting motor, said driving motor, said hopping actuating motor and said steering motor in response to said control signals.

6. A toy wheeled vehicle having a chassis and a selectable vehicle suspension system, comprising:

(a) a vehicle frame having a longitudinal axis, said chassis attached to said frame;

(b) longitudinally spaced front and rear axles supported on said frame, said front and rear axles extending in a transverse direction to said longitudinal axis;

(c) a first and second set of wheels attached to said front and rear axles, respectively;

(d) at least one lifting motor mounted on said frame and providing a first rotational output to a first arm, said first arm angularly displaced by said lifting motor in response to said first rotational output and having proximal and distal ends, said first arm connected to said first rotational output at said proximal end and connected to a vertically extending guide post at said distal end, whereby pivoting of said first arm moves said guide post vertically with respect to said frame, said guide post having attachment means to said chassis, whereby said vertical movement of said guide post moves said chassis vertically with respect to said frame;

(e) at least one driving motor mounted on said frame and providing a second rotational output to a shaft connected to said rear axle, said shaft rotated by said driving motor in response to said second rotational output and having first and second ends, said shaft connected to said second rotational output at said first end and connected to said rear axle at said second end, whereby rotating of said shaft rotates said rear axle;

(f) at least one hopping actuating motor mounted on said frame and providing a third rotational output to an offset cam, said offset cam rotated by said hopping actuating motor in response to said third rotational output and having third and fourth ends, said offset cam connected to said third rotational output at said third end and in contact with a rotatable pin connected to said front axle at said fourth end, whereby rotating said offset cam angularly displaces said rotatable pin and vertically moves said frame with respect to said front axle;

(g) a steering motor mounted on said frame and connected to said front axle, said steering motor having means for steering said vehicle;

(h) at least one power supply mounted on said frame, said power supply having electrical connections with said lifting motor, said driving motor, said hopping actuating motor and said steering motor, and at least one switch for selectively energizing said lifting motor, said driving motor and said hopping actuating motor, said steering motor being electrically connected to said driving motor whereby said energizing of said driving motor energizes said steering motor;

(i) a control circuit mounted on said frame and having electrical connection means with said power supply through said switch and said lifting motor, said driving motor, said hopping actuating motor and said steering motor; and (j) a radio controller having means for transmitting control signals to said control circuit, said control circuit having means for selectively controlling the movement of said first, second and third rotational outputs, respectively, of said lifting motor, said hopping actuating motor and said driving motor, respectively, and said steering motor, in response to said control signals, whereby vehicle, chassis and frame movement is individually or in unison controlled.

7. A toy wheeled vehicle as set forth in claim 6, wherein said chassis has four corners and said vehicle has four of said lifting motors for tilting, raising, and lowering said corners in unison or independently from one another in response to said control signals from said radio controller.

8. A toy wheeled vehicle as set forth in claim 6, wherein said chassis has at least one opening that is aligned with said guide post, said guide post has bottom and top ends and is connected to said first arm at said bottom end, said top end has an extending ledge that has a surface area greater than that of said opening and a channel spaced from said ledge and receives a fastener, whereby said top end is extended through said opening until said ledge is placed adjacent to the bottom surface of said chassis, said channel is located above said opening and said fastener is inserted in said channel for attaching said guide post to said chassis.

9. A toy wheeled vehicle as set forth in claim 6, wherein said control circuit has means for selectively controlling the individual or in unison movement of said lifting motor, said driving motor, said hopping actuating motor and said steering motor in response to said control signals.

* * * * *

UNITED STATES PATENT AND TRADEMARK OFFICE

CERTIFICATE OF CORRECTION

PATENT NO. : 5,785,576

DATED : July 28, 1998

INVENTOR(S) : Wyatt H. Belton

It is certified that error appears in the above-identified patent and that said Letters Patent is hereby corrected as shown below:

In Claim 4, Line 1, after the phrase "as set forth in claim" delete "-10-" and insert --1--.

Signed and Sealed this

First Day of December, 1998

*Attest:*

*Attesting Officer*

Bruce Lehman

BRUCE LEHMAN

*Commissioner of Patents and Trademarks*